US010639515B2

(12) United States Patent
Simmons

(10) Patent No.: US 10,639,515 B2
(45) Date of Patent: May 5, 2020

(54) ATHLETIC TRAINING PLATFORM EXERCISE DEVICE

(71) Applicant: Louie Simmons, Columbus, OH (US)

(72) Inventor: Louie Simmons, Columbus, OH (US)

( * ) Notice: Subject to any disclaimer, the term of this patent is extended or adjusted under 35 U.S.C. 154(b) by 88 days.

(21) Appl. No.: 15/441,468

(22) Filed: Feb. 24, 2017

(65) Prior Publication Data

US 2017/0246504 A1 Aug. 31, 2017

Related U.S. Application Data

(60) Provisional application No. 62/300,944, filed on Feb. 29, 2016.

(51) Int. Cl.

| | |
|---|---|
| ***A63B 21/072*** | (2006.01) |
| ***A63B 21/00*** | (2006.01) |
| ***A63B 23/04*** | (2006.01) |
| ***A63B 21/062*** | (2006.01) |
| ***A63B 23/035*** | (2006.01) |
| ***A63B 21/16*** | (2006.01) |
| *A63B 21/005* | (2006.01) |

(Continued)

(52) U.S. Cl.

CPC .... *A63B 21/0724* (2013.01); *A63B 21/00065* (2013.01); *A63B 21/0626* (2015.10); *A63B 21/154* (2013.01); *A63B 21/16* (2013.01); *A63B 21/4009* (2015.10); *A63B 21/4043* (2015.10); *A63B 23/03566* (2013.01); *A63B 23/047* (2013.01); *A63B 23/0458* (2013.01); *A63B 23/0464* (2013.01); *A63B 21/005* (2013.01); *A63B 21/00069* (2013.01); *A63B 21/0083* (2013.01); *A63B 21/0087* (2013.01); *A63B 21/0442* (2013.01); *A63B 21/0552* (2013.01); *A63B 21/4035* (2015.10); *A63B 23/03558* (2013.01); *A63B 69/0057* (2013.01); *A63B 2023/0411* (2013.01); *A63B 2071/0063* (2013.01); *A63B 2071/0072* (2013.01); *A63B 2225/093* (2013.01)

(58) Field of Classification Search

CPC ..... A63B 21/00058; A63B 21/00076; A63B 21/062; A63B 21/0622; A63B 21/0624; A63B 21/0626; A63B 21/0628; A63B 21/063; A63B 21/0632

See application file for complete search history.

(56) References Cited

U.S. PATENT DOCUMENTS 3,861,215 A * 1/1975 Bradley ..... A63B 21/015 482/116
4,125,258 A * 11/1978 McArthur ..... A63B 21/06 482/100

(Continued)

*Primary Examiner* — Joshua Lee
(74) *Attorney, Agent, or Firm* — Michael J. Gallagher, Esq.; Luper Neidenthal & Logan, LPA

(57) ABSTRACT

A multi-purpose athletic training platform exercise device is provided. A user may stand atop a platform and exercise while connected to a downward pulling source of resistance. This machine allows the user to walk forwards, backwards and side-to-side freely while still having attachment to the resistance source via a connecting means. This will activate all the muscles in the lower body while tractioning the lower back and helping to reduce pelvic tilt. The resistance may be varied during the user effort. The user is able to step off the machine to climb up or down a step, or walk up and down a ramp that may be provided.

18 Claims, 4 Drawing Sheets

(51) Int. Cl.

| | |
|---|---|
| *A63B 21/008* | (2006.01) |
| *A63B 21/055* | (2006.01) |
| *A63B 21/04* | (2006.01) |
| *A63B 71/00* | (2006.01) |
| *A63B 69/00* | (2006.01) |

(56) References Cited

U.S. PATENT DOCUMENTS 4,349,194 A * 9/1982 Lambert, Jr. ..... A63B 21/155 482/100
4,577,861 A * 3/1986 Bangerter ..... A63B 23/03533 482/100
4,589,658 A * 5/1986 Gibson ..... A63B 21/4001 482/105
4,856,773 A * 8/1989 Deola ..... A63B 21/063 482/102
4,863,163 A * 9/1989 Wehrell ..... A63B 5/16 482/123
5,147,263 A * 9/1992 Mueller ..... A63B 21/00181 482/112
5,158,518 A * 10/1992 Pizzuto ..... A63B 23/0405 482/102
5,158,520 A * 10/1992 Lemke ..... A63B 21/06 482/103
5,306,220 A * 4/1994 Kearney ..... A63B 23/00 482/104
5,512,029 A * 4/1996 Barnard ..... A63B 21/0552 482/124
5,562,578 A * 10/1996 Guillemette ..... A63B 23/0488 482/100
5,941,807 A * 8/1999 Cassidy ..... A63B 22/14 482/130
6,224,512 B1 * 5/2001 Arnesson ..... A63B 21/00181 482/5
6,676,569 B1 * 1/2004 Radow ..... A63B 22/0235 482/4
7,867,144 B2 * 1/2011 Quinn ..... A63B 21/068 482/101
8,147,389 B1 * 4/2012 Hoole ..... A63B 23/1227 482/100
8,221,295 B2 * 7/2012 Wilkins ..... A63B 5/00 482/130
8,961,375 B2 * 2/2015 Henesey ..... A63B 21/065 482/105
9,616,274 B2 * 4/2017 Wehrell ..... A61H 1/0229
9,802,077 B2 * 10/2017 MacDonald ..... A63B 22/14
10,143,880 B1 * 12/2018 Boatwright ..... A63B 21/153
2005/0032613 A1 * 2/2005 Wehrell ..... A63B 21/055 482/133
2006/0199706 A1 * 9/2006 Wehrell ..... A61H 1/0229 482/92
2007/0197353 A1 * 8/2007 Hundley ..... A63B 22/02 482/93
2007/0275833 A1 * 11/2007 Ramsey ..... A63B 23/085 482/79
2008/0227607 A1 * 9/2008 Nizam ..... A63B 21/154 482/100
2009/0082181 A1 * 3/2009 Salvioli ..... A63B 21/159 482/114
2009/0163337 A1 * 6/2009 Petrakov ..... A61H 1/005 482/147
2009/0264265 A1 * 10/2009 Contreras ..... A63B 21/00047 482/99
2013/0040787 A1 * 2/2013 Giannelli ..... A63B 21/062 482/97
2014/0141948 A1 * 5/2014 Aronson ..... A63B 21/023 482/128
2015/0290489 A1 * 10/2015 Simmons ..... A63B 21/0087 482/91
2016/0317866 A1 * 11/2016 Fung ..... A63B 24/0003
2017/0291057 A1 * 10/2017 Strickland ..... A63B 21/154
2019/0076691 A1 * 3/2019 Smith ..... A63B 21/154

* cited by examiner

ATHLETIC TRAINING PLATFORM EXERCISE DEVICE

CROSS-REFERENCE TO RELATED APPLICATIONS

This application claims the benefit of U.S. provisional patent application Ser. No. 62/300,944, filed on Feb. 29, 2016, later U.S. Pat. Publ. 20150290489; and now U.S. Pat. No. 10,065,060; all of which is incorporated by reference as if completely written herein.

STATEMENT REGARDING FEDERALLY SPONSORED RESEARCH OR DEVELOPMENT

Not applicable.

TECHNICAL FIELD

The present disclosure relates to the field of sports equipment, and more particularly, to a athletic training platform exercise device, particularly to a device that imparts variable resistance to extension of the legs during exercise.

SUMMARY OF INVENTION

In its most general configuration, the presently disclosed athletic training platform exercise device is a device that allows a user to apply variable resistance to the extension of the legs during exercise.

The athletic training platform device, in several embodiments, meant by way of illustration and not limitation, is a device that allows an individual to train in multiple ranges of motion while simultaneously tractioning the spine and constantly stimulating the gluteus maximus, medius, spinal erectors, hamstrings, quadriceps, and gastrics, via a user interface that includes, in some embodiments, a belt attachment or harness.

Time under tension is the key component that builds strength in human exercise. Due to the design of various embodiments of the present invention, a user may perform walks or grappling for an extended period with a desired resistance, which may be supplied by various weight plates, constantly pulling down from the hips. Depending on the exercise or movement selected, the athletic training platform will build tremendous strength in the glutes, hamstrings, hips, lower back and upper back, while increasing lactate threshold, rate of force development and dynamic strength endurance.

The device, in some embodiments, is based around a user enclosure with a platform having a center connection to a source of resistance inferior to and approximately near the center of the platform. The resistance source, which commonly could be weight plates, may also be supplied by hydraulic pistons, or, in fact, any of the possible sources of resistance that would be well-known to one skilled in the art. A belt may be attached to the resistance system, most commonly by means of a heavy duty wire cable. This heavy duty wire cable is attached via pulleys to a resistance unit system that can house weight plates, bands, chains or even a weight stack. The weight applied to the cable at the opposite end of the cable from the user provides the resistance to the body.

The user may place the belt around the lower back and on top the hips, and standing in a full upright position, and then assume what is referred to as the start position. The weight holder system may be held in place via a height adjustment stop, which may be fabricated as a heavy duty metal pin. The height adjustment stop prevents the weights or weight stack from falling to the ground and allows a user to begin at an intermediate point of initial resistance when lifted, or which can be used to prevent an overshoot if the weight is lifting with excessive or unexpected force.

From the start position, the weight or weight stack may be lifted off the height adjustment stop as the user simply pulls the cable, and hence the weight, towards themselves. They can then achieve full range of motion.

This machine allows the user to walk forwards, backwards and side-to-side freely while still having the cable attached via the belt on their body to the weights or weight stack. This will activate all the muscles in the lower body while tractioning the lower back and helping to reduce pelvic tilt. The user is able to step off the machine to climb up or down a step, or walk up and down a ramp that may be provided.

This device has adjustable side rails that may range in position from the bottom of the platform to a predetermined height. These side rails are capable of holding a variety of resistance objects, such as weight plates on a barbell, somewhat akin to the functioning of a power rack or "Smith" rack. For example, a barbell bearing weight plates may be placed across the side rails. The barbell would rest on those rails until lifted by a user. Being able to adjust the height of the side rails of the device provides different heights for users to perform a number of lifts from, such as: deadlifts, cleans, snatches, squats, and others while still wearing the belt and stimulating/tractioning the lower body.

Enclosure attachments to the side of the machine can be used to anchor elastic bands, cords, or other devices to provide additional amounts and types of resistance, again allowing various methods of throwing and rehabilitation work while providing stimulation/tractioning to the lower back and lower body.

This provides a significant therapeutic effect as the improved blood flow to lower back and lower body can help aid recovery time. It also helps users to safely perform lifts such as squats and deadlifts. The athletic training platform device places no load on the upper back or shoulders due to the weight belt pulling from the hips downward. This will traction out the spine and can help reduce pelvic tilt.

BRIEF DESCRIPTION OF THE DRAWINGS

Without limiting the scope of the athletic training platform exercise device as claimed below and referring now to the drawings and figures:

Figure 1:
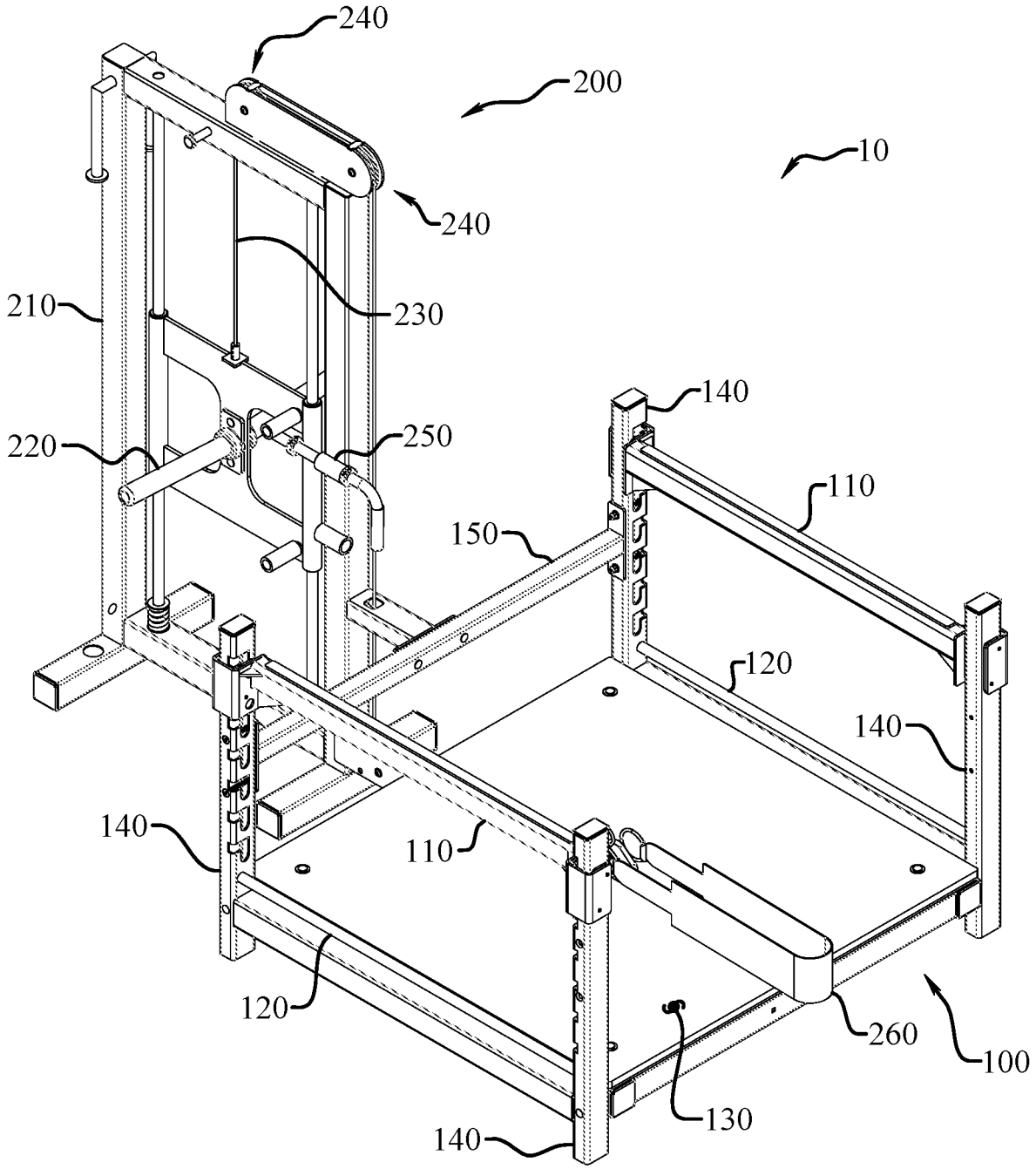
FIG. 1 is an elevated perspective view of an embodiment of the present invention.

These drawings are provided to assist in the understanding of the exemplary embodiments of the presently disclosed athletic training platform exercise device as described in more detail below and should not be construed as unduly limiting the athletic training platform exercise device. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

An athletic training platform exercise device (10) is seen well in FIGS. 1-4. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the athletic training platform device (10), and is not intended to represent the only form in which the athletic training platform device (10) may be constructed or utilized. The description sets forth the designs, functions, means, and methods of utilizing the athletic training platform device (10) in connection with the illustrated embodiments. It is to be understood, however, that the same or equivalent functions and features may be accomplished by different embodiments that are also intended to be encompassed within the spirit and scope of the athletic training platform device (10).

Numerous alterations, modifications, and variations of the preferred embodiments disclosed herein will be apparent to those skilled in the art and they are all anticipated and contemplated to be within the spirit and scope of the athletic training platform exercise device (10). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the athletic training platform device (10) are described herein, it is to be understood that the practice of such additional modifications and variations and the equivalents thereof, are within the spirit and scope of the invention.

What is claimed then, as seen well in FIGS. 1-4, includes an athletic training platform exercise device (10) having a user enclosure (100) with a platform (130), wherein the platform (130) has a platform opening (160) allowing passage of a connecting means (230) connected to a resistance unit (200). The resistance unit (200) may provide variable resistance to the connecting means (230). One skilled in the art will realize that such a construction is ideally suited to "squat" type exercise, however, the teaching is specifically meant to reach beyond that to all forms of exercise where this type of resistance may be useful.

The platform (130) may be supported by standards (140) supporting at least two side rails (110), or in some embodiments, three side rails (110), allowing for one side to remain open to access the platform (130) more easily. Equally well, a fourth side rail (110) could be provided.

Figure 2:
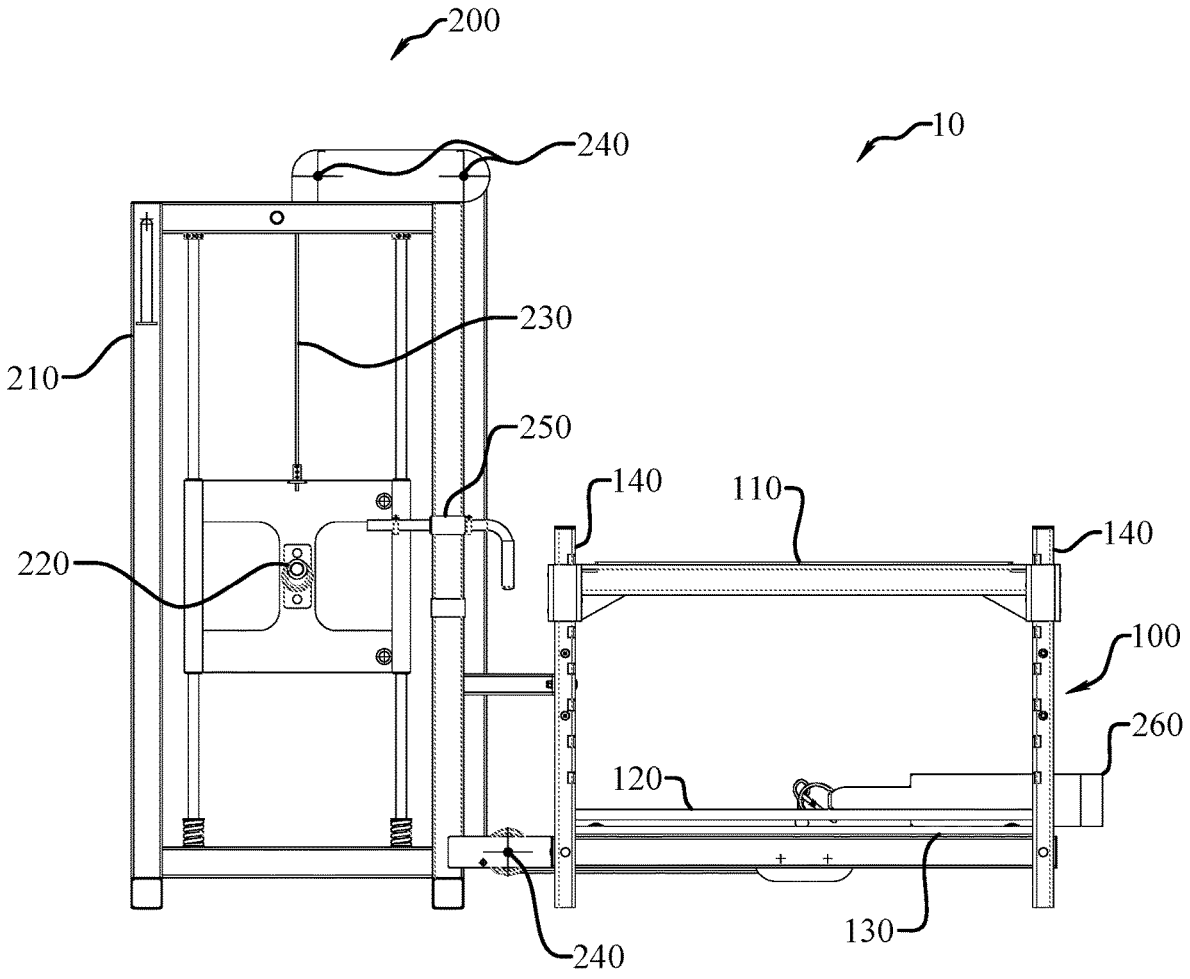
FIG. 2 is a side elevation view of the embodiment of FIG. 1.

In one series of embodiments, as seen well in FIGS. 1-2, the resistance unit (200) may include at least one weight holder (220) movably positioned on a weight tower (210) allowing vertical motion of the weight holder (220). In yet another series of embodiments, not pictured, the resistance unit (200) may further include a resistance unit (200) producing a resistance selected from the types of resistance consisting of electrical, hydraulic and elastic resistance.

In a further series of embodiments, the resistance unit (200) may further include a resistance unit (200) producing a variable resistance during a displacement of the connecting means (230). For such a series, the disclosures of U.S. patent application Ser. No. 14/253,159; U.S. Pat. Publ. 20150290489, now U.S. Pat. No. 10,065,060, is explicitly disclosed as though fully rewritten herein. By way of example and not limitation, such a series of embodiments might be denominated a static-dynamic device, suitable for a quick-release method of training.

In certain embodiments of a static dynamic exercise device, although one skilled in the art would recognize many other embodiments based on the principles taught herein, the device might include four basic components. The first is at least one spatially displaceable object having a predetermined mass, or in other embodiments, any source of resistance to movement. In several common embodiments, the spatially displaceable object will be one or more weights. There is no particular design for a weight to be configured, other than it having a predetermined mass or resistance; shape or materials are inconsequential, although in common embodiments, steel weightlifting plates may be utilized. However, it is not necessary for the spatially displaceable object to be a weight, and it could also be a pressure piston, actuated within a pressure cylinder, a means of elastic resistance such as a spring or elastic band, or any other object that is capable of generating a static resistance when there is no movement, and with movement, is capable of creating a dynamic resistance.

Such a static-dynamic exercise device may include a resistance unit (200) coupled to the spatially displaceable object that is capable of producing a variable resistance to movement of the spatially displaceable object. The resistance unit may be capable of generating at least a resistance to movement equal to or greater than the user-applied force and the resistance unit (200) may be reversibly alternated between at least two predetermined levels of resistance. Again, no particular construction is necessary for the resistance system, other than the requirement that it be capable of a first resistance preventing the user-applied force from displacing the spatially displaceable object, and that this resistance may be released such that the resistance system generates a second resistance less than the user-applied force, thereby allowing the user to spatially displace the spatially displaceable object. The second resistance may be, but is not necessarily, optimally as low as can be practically achieved, given the necessary constraints of friction within the mechanism. As detailed above, the term "displace" includes any form of variable resistance, particularly including that which may be provided by pneumatic or hydraulic pressure pistons, or by any form of providing elastic resistance.

In one series of embodiments, the resistance unit (200) includes a pressure generator capable of creating a pressure in fluid communication with a resistance interlock. Pressure produced by the pressure generator may be transmissible to the resistance interlock, thereby creating the variable resistance to movement of the spatially displaceable object. In a common series of embodiments, the pressure interlock creates the variable resistance to movement of the spatially displaceable object by means of a plunger or piston exerting a force against the connecting means (230). The resistance unit (200) may have a controller capable of regulating the pressure transmissible to the resistance interlock. In a typical embodiment, the resistance interlock may include a pneumatic, hydraulic, or electrically powered piston, such that the resistance interlock has a first position in which little or no force is applied by the resistance unit (200) and at least a second position wherein a force equal to that necessary to prevent movement of the connecting means (230) by application of a user-applied force is applied by the resistance unit (200). Any controller may be capable of rapid alternation between the first and second positions.

The resistance interlock may be reversibly capable of producing a variable resistance to movement of the connecting means (230), including at least a resistance in excess of the user-applied force and wherein the resistance unit (200) may be reversibly alternated between at least two predetermined levels of resistance. The at least two predetermined levels of resistance may include a level of no resistance to movement, other than the necessary constraints of friction within the mechanism, and a level of resistance capable of preventing movement of the connecting means (230) by the application of a user-applied force.

Thus, what is claimed includes an embodiment where the resistance unit (200) has a first position in which no resistance is applied by the resistance unit (200) and at least a second position wherein a resistance equal to that necessary to prevent movement of the connecting means (230) is applied by the resistance unit (200). The resistance unit (200) may be alternatable between the first position and the second position in a time interval of one second or less, while in another embodiment, the resistance unit (200) may be alternatable between the first position and the second position in a time interval of three seconds or less. Generally, the shortest possible times between alternations of positions may be desirable, including times as low as one-tenth of a second.

Figure 3:
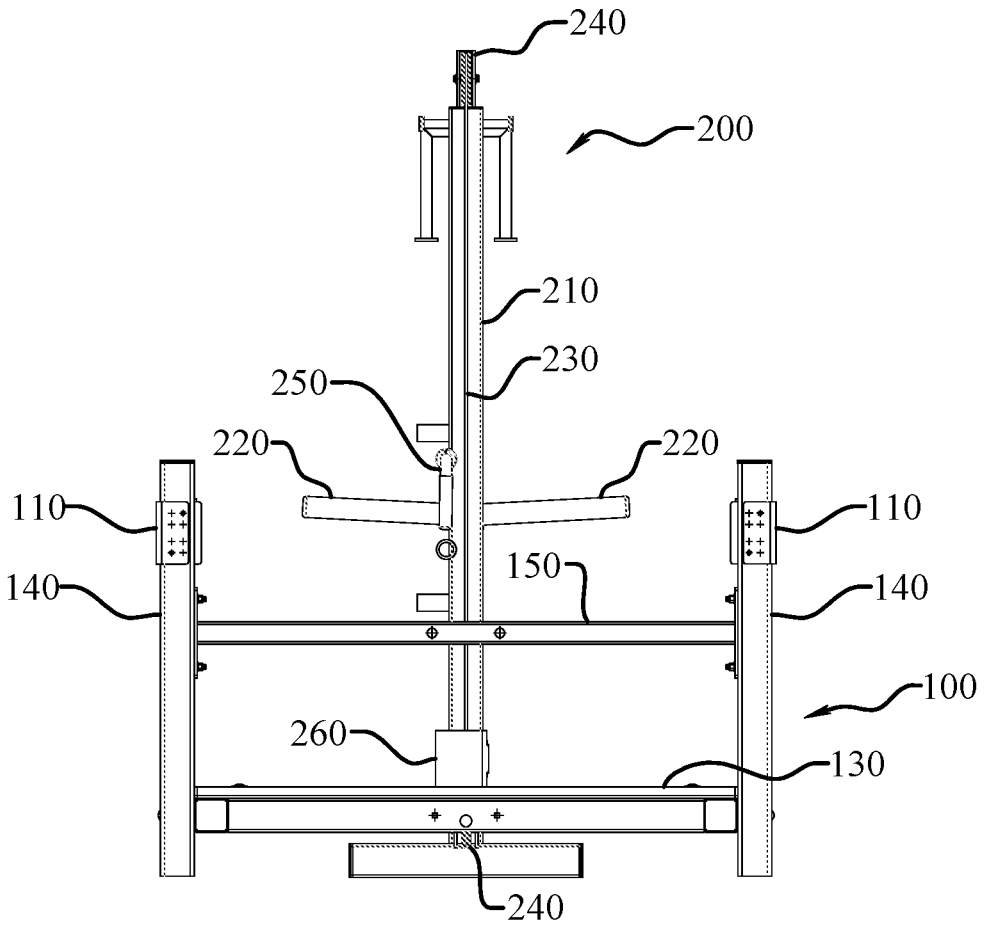
FIG. 3 is an front view of the embodiment of FIG. 1.
Figure 4:
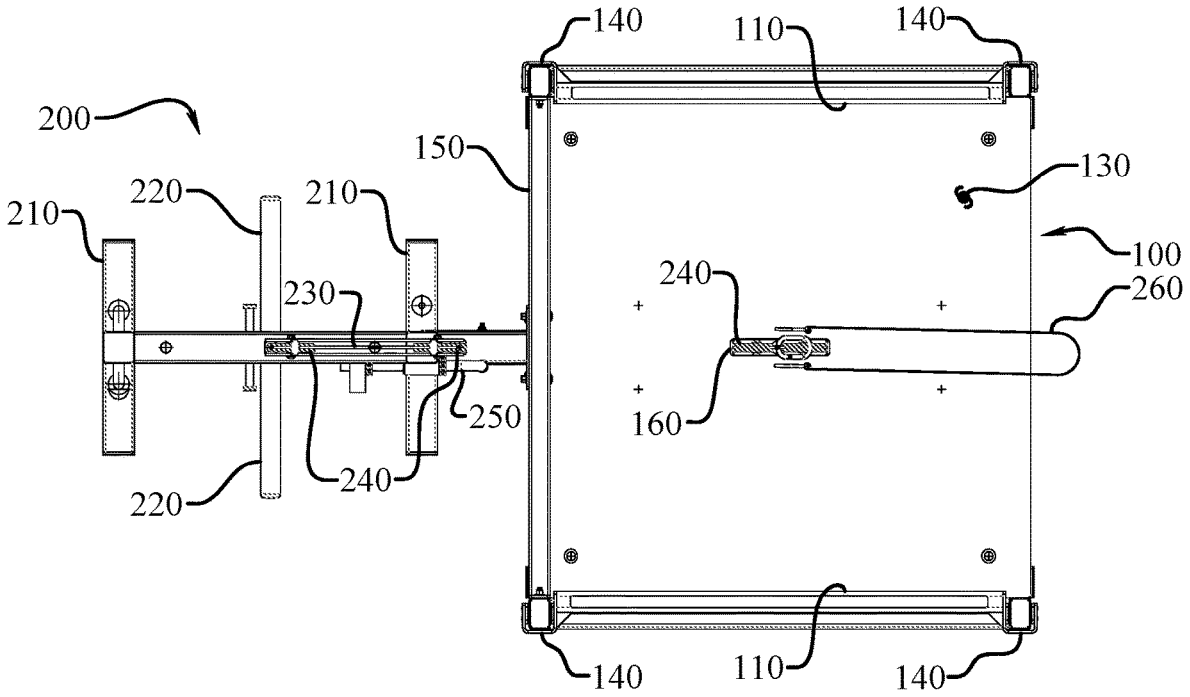
FIG. 4 is a top view of the embodiment of FIG. 1.

As described, in some embodiments, the claimed device (10), as seen well in FIGS. 1-3, may have a weight tower (210) that includes a height adjustment (250) that establishes a limit on the vertical motion of the weight holder (220). This would, among other advantages, would allow an intermediate starting point for lifting a weight stack as well as to tend to prevent an "overshoot" if the weight is raised with unexpected force.

In many embodiments, and as seen in FIGS. 1-4, but not necessarily all, the connecting means (230) may be a cable (230) carried on at least one pulley (240). In certain embodiments, the connecting means (230) or cable (230) may be connected to a user interface (260), and this connection may be effected by means of a multi-axial connector allowing motion between the connecting means (230) and the user interface (260) in multiple axes. While other solutions would be known by one skilled in the art, such a multi-axial connector could be as simple as a swiveling shackle. The user interface (260) may be a harness (260) capable of at least partially surrounding a body of a user, while in other embodiments, the user interface (260) may be a hand-held user interface (260). In sum, any means of allowing the user to be coupled to the device (10) may be sufficient.

As seen well in FIG. 1, the enclosure (100) may further include at least one back rail (150) connecting at least two standards (140). Such rails (150) may help a user stay centered on the platform (130) and in other embodiments, also seen well in FIG. 1, there may be at least one enclosure attachment (120) below a vertical level of the side rails (110) which may anchor resistance devices. Such a resistance device or devices my produce a resistance selected from the types of resistance consisting of electrical, hydraulic and elastic resistance. All that is required of a resistance device (110) is that it increases a user effort necessary to displace the connecting means (230) and/or the user interface (260), or in some way changes the dynamics of the user effort. As discussed, such a change in dynamics could involve the user exerting force against an unyielding resistance, only to have that resistance modified at some point during the effort.

In some embodiments, and especially in some devices as may be appreciated from U.S. Pat. Publication 20150290489, now U.S. Pat. No. 10,065,060, the resistance device (120) may include a resistance device (120) producing a variable resistance during a displacement of the connecting means (230). Such a variable resistance during the displacement of the connecting means (230) could include various patterns of resistance, e.g., resistance increasing, decreasing or otherwise cycling between increasing and decreasing, during the displacement. In some embodiments, the device (10) is ideally suited to a quick-release method of training, where a connecting means may be locked against movement, and then suddenly released for maximal user effort.

In another embodiments, an athletic training platform exercise device (10) can include a user enclosure (100) having a platform (130) supported by standards (140) supporting at least two side rails (110), as seen well in FIGS. 1-4. The platform (130) may have a platform opening (160) allowing passage of a cable (230) carried on at least one pulley (240), which is in turn connected to a resistance unit (200) further comprising at least one weight holder (220) movably positioned on a weight tower (210) allowing vertical motion of the weight holder (220). With further reference to FIGS. 1-4, the cable (230) may be further connected to a user interface (260) by means of a multi-axial connector allowing motion between the cable (230) and the user interface (260) in multiple axes. In such embodiments, the resistance unit (200) may provide variable resistance to the cable (230).

In yet another embodiment, and again as seen in FIGS. 1-4, an athletic training platform exercise device (10), may include a user enclosure (100) having a platform (130), wherein the platform (130) has a platform opening (160) allowing passage of a cable (230) connected to a resistance unit (200) capable of producing a variable resistance during a displacement of the connecting means. Such resistance may be selected from the types of resistance consisting of electrical, hydraulic and elastic resistance including a variable resistance during a displacement of the connecting means (230). The cable (230) may be further connected to the user interface (260) by means of a multi-axial connector allowing motion between the connecting means (230) and the user interface (260) in multiple axes.

And, as further described above, the device (10) may be constructed such the resistance unit (200) has a first position in which no resistance is applied by the resistance unit (200) to the cable (230) and at least a second position wherein a resistance equal to that necessary to prevent movement of the cable (230) may be applied by the resistance unit (200).

Numerous alterations, modifications, and variations of the preferred embodiments disclosed herein will be apparent to those skilled in the art and they are all anticipated and contemplated to be within the spirit and scope of the disclosed specification. For example, although specific embodiments have been described in detail, those with skill in the art will understand that the preceding embodiments and variations can be modified to incorporate various types of substitute and or additional or alternative materials, relative arrangement of elements, order of steps and additional steps, and dimensional configurations. Accordingly, even though only few variations of the method and products are described herein, it is to be understood that the practice of such additional modifications and variations and the equivalents thereof, are within the spirit and scope of the method and products as defined in the following claims. The corresponding structures, materials, acts, and equivalents of all means or step plus function elements in the claims below are intended to include any structure, material, or acts for performing the functions in combination with other claimed elements as specifically claimed.

I claim:

1. An athletic training platform exercise device (10), comprising:

a user enclosure (100) having a platform (130) fixedly supported by standards (140) extending above the platform (130) supporting at least the platform, a weight of a user and two adjustable-height side rails (110), wherein the platform (130) has a central platform opening (160) allowing passage of a connecting means (230) connected to a resistance unit (200) by a multi-axial connector, said multi-axial connector lying fully below a platform user surface;

the standards (140) and side rails (110) having structural strength supportable of a weight greater than the weight of the user, and wherein the resistance unit (200) provides variable resistance to the connecting means (230).

2. The device according to claim 1, wherein the resistance unit (200) comprises at least one weight holder (220) movably positioned on a weight tower (210) allowing vertical motion of the weight holder (220).

3. The device according to claim 1, wherein the resistance unit (200) further comprises a resistance unit (200) producing a resistance selected from the types of resistance consisting of electrical, hydraulic and elastic resistance.

4. The device (10) according to claim 2, wherein the weight tower (210) further comprises a height adjustment (250) that establishes a limit on an upwards vertical motion of the weight holder (220) that is less than the full range of vertical motion of the weight holder.

5. The device according to claim 1, wherein the resistance unit (200) further comprises a resistance unit (200) producing a variable resistance during a displacement of the connecting means (230).

6. The device (10) according to claim 1, wherein the resistance unit (200) has a first position in which no resistance is applied by the resistance unit (200) and at least a second position wherein a resistance equal to that necessary to prevent movement of the connecting means (230) is applied by the resistance unit (200).

7. The device (10) according to claim 6, wherein the resistance unit (200) is alternatable between the first position and the second position in a time interval of one second or less.

8. The device (10) according to claim 6, wherein the resistance unit (200) is alternatable between the first position and the second position in a time interval of three seconds or less.

9. The device (10) according to claim 1, wherein the connecting means (230) is a cable (230) carried on at least one pulley (240).

10. The device (10) according to claim 1, wherein the connecting means (230) is further connected to a user interface (260).

11. The device (10) according to claim 10, wherein the user interface (260) is a harness (260) capable of at least partially surrounding a body of a user.

12. The device (10) according to claim 10, wherein the user interface (260) is a hand-held user interface (260).

13. The device (10) according to claim 1, wherein the user enclosure (100) further comprises at least one back rail (150) connecting at least two standards (140).

14. The device (10) according to claim 1, wherein the user enclosure (100) further comprises at least one enclosure attachment (120) below a vertical level of the side rails (110) which may anchor resistance devices.

15. The device (10) according to claim 14, wherein the resistance devices further comprises a resistance device producing a resistance selected from the types of resistance consisting of electrical, hydraulic and elastic resistance.

16. The device according to claim 1, wherein the variable resistance further comprises at least two resistances levels, a first resistance level in which the resistance is locked out against user movement, and a second resistance level allowing user movement, wherein the first and second resistance levels may be alternated in a near-instantaneous manner.

17. An athletic training platform exercise device (10), comprising:

a user enclosure (100) having a platform (130) fixedly supported by standards (140) extending above the platform (130) supporting at least the platform, a weight of a user and two adjustable-height side rails (110), wherein the platform (130) has a platform opening (160) allowing passage of a cable (230) carried on at least one pulley (240) connected to a resistance unit (200) further comprising at least one weight holder (220) movably positioned on a weight tower (210) allowing vertical motion of the weight holder (220), wherein the cable (230) is connected to a user interface (260) by means of a multi-axial connector allowing motion between the cable (230) and the user interface (260) in multiple axes; and wherein the resistance unit (200) provides variable resistance to movement of the cable (230).

18. The device according to claim 17, wherein the variable resistance further comprises at least two resistances levels, a first resistance level in which the resistance is locked out against user movement, and a second resistance level allowing user movement, wherein the first and second resistance levels may be alternated in a near-instantaneous manner.

* * * * *